US010052864B2

(12) United States Patent
Tanaka

(10) Patent No.: US 10,052,864 B2
(45) Date of Patent: Aug. 21, 2018

(54) PRINTING APPARATUS AND SHEET DISCHARGE METHOD THEREFOR

(71) Applicant: BROTHER KOGYO KABUSHIKI KAISHA, Nagoya, Aichi (JP)

(72) Inventor: Tsutomu Tanaka, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 124 days.

(21) Appl. No.: 15/070,228

(22) Filed: Mar. 15, 2016

(65) Prior Publication Data

US 2016/0271932 A1 Sep. 22, 2016

(30) Foreign Application Priority Data

Mar. 17, 2015 (JP) ..... 2015-053348

(51) Int. Cl.
*B65H 31/24* (2006.01)
*B41F 21/00* (2006.01)
(Continued)

(52) U.S. Cl.
CPC ..... *B41F 21/00* (2013.01); *B65H 31/02* (2013.01); *B65H 31/24* (2013.01); *B65H 39/11* (2013.01); *B65H 43/06* (2013.01); *G03G 15/6564* (2013.01); *B65H 2301/4212* (2013.01); *B65H 2405/332* (2013.01); *B65H 2408/111* (2013.01); *B65H 2511/152* (2013.01);
(Continued)

(58) Field of Classification Search
CPC ..... B65H 43/06; G03G 2215/00911; G06F 2206/1506
See application file for complete search history.

(56) References Cited

U.S. PATENT DOCUMENTS 5,106,076 A * 4/1992 Fujita ..... G03G 15/6538 271/287
5,358,238 A * 10/1994 Mandel ..... B65H 31/24 101/2
(Continued)

FOREIGN PATENT DOCUMENTS

JP S628943 A 1/1987
JP H0445060 A 2/1992
(Continued)

OTHER PUBLICATIONS

Notification of Reasons for Rejection dated Jul. 3, 2018 received from the Japanese Patent Office in related JP 2015-053348.

*Primary Examiner* — Jennifer Simmons
(74) *Attorney, Agent, or Firm* — Scully, Scott, Murphy & Presser, P.C.

(57) ABSTRACT

A controller of a printing apparatus is configured to determine whether there is a stack-full tray, restrict discharging of the printing sheet to the stack-full tray and reduce the number of copies made in the sort printing process, store the page number of the page currently printed in association with a stack-full tray, obtain image data corresponding to the page associated with the stack-full tray onwards when it is determined that the full stack status of the stack-full trays is released, and the obtained print images with making the tray of which status is changed from the full status to the non-full status.

8 Claims, 11 Drawing Sheets

(51) Int. Cl.

| | |
|---|---|
| ***B65H 39/11*** | (2006.01) |
| ***B65H 31/02*** | (2006.01) |
| ***B65H 43/06*** | (2006.01) |
| ***G03G 15/00*** | (2006.01) |

(52) U.S. Cl.
CPC .... *B65H 2511/414* (2013.01); *B65H 2801/06* (2013.01); *G03G 2215/00911* (2013.01)

(56) References Cited

U.S. PATENT DOCUMENTS

| | | | | |
|---|---|---|---|---|
| 6,009,804 | A * | 1/2000 | Yamada | B65H 39/10 101/2 |
| 2002/0081122 | A1* | 6/2002 | Ohwa | G03G 15/6538 399/82 |
| 2010/0044949 | A1* | 2/2010 | Nakamura | B65H 29/60 271/3.17 |
| 2011/0233852 | A1* | 9/2011 | Ikarashi | B65H 39/10 271/207 |
| 2012/0248694 | A1* | 10/2012 | Cheng | B41J 13/106 271/279 |
| 2012/0267849 | A1* | 10/2012 | Mutsuno | G03G 15/6541 271/279 |

FOREIGN PATENT DOCUMENTS

| | | | |
|---|---|---|---|
| JP | H07203118 | A | 8/1995 |
| JP | H0626586 | A | 1/1996 |
| JP | 11352848 | A * | 12/1999 |
| JP | H11352848 | A | 12/1999 |
| JP | 2000-335050 | A | 12/2000 |

* cited by examiner

PRINTING APPARATUS AND SHEET DISCHARGE METHOD THEREFOR

CROSS-REFERENCE TO RELATED APPLICATION

This application claims priority under 35 U.S.C. § 119 from Japanese Patent Application No. 2015-053348 filed on Mar. 17, 2015. The entire subject matter of the application is incorporated herein by reference.

BACKGROUND

Technical Field

The present disclosures relate to a printing apparatus and a sheet discharge method employed in the printing apparatus. More specifically, the present disclosures relate to a technique of discharging printing sheets onto multiple discharge trays in a sorted manner according to a page order.

Related Art

Conventionally, there has been known a printing apparatus having a plurality of discharge trays, and capable executing a sort printing using the plurality of discharging trays. According to an example of the sort printing, when M copies of N pages of images are printed, initially the first page of image is printed by M times, and the printing sheets (M sheets) are sorted to respective discharge trays. Thereafter, each of the second, third . . . , and N-th page of image is printed on M pages of the printed sheets, which are sorted and discharged onto respective discharge trays.

SUMMARY

When, for example, three copies of images for three pages are printed, printing of the first page and discharging of the same onto a first tray, printing of the first page and discharging of the same on a second tray, printing of the first page and discharging of the same on a third tray, printing of a second page and discharging the same on the first tray, . . . are executed in this order.

When one of the discharge tray (i.e., one of the first, second and third trays) has a problem (e.g., an abnormal status such as a stack full status which is a status where the tray is full of discharged sheets), according to a conventional printing apparatus, one of the other trays is used instead of the tray having a problem.

However, when printing and discharging are executed in the sort printing as mentioned above, a correct sorting result may not be obtained.

For example, assume that three copies of images for three pages are printed, and after the first pages are printed and discharged, the third tray if full of sheets. In such a case, the printing sheets on which the image of the second page is printed cannot be discharged on the third tray, and may be discharged on, for example, the first tray. Then, the printing sheets stacked on the first tray bear first image, second image and first image, which is not a normal sorting result. If the third pages are discharged on the second tray, first tray and second tray, in this order, the second tray does not exhibit the normal sorted results.

In consideration of the above, the present disclosures may provide a technique with which a correct sorting result is expected when multiple discharge trays are used and printing sheets are sorted and discharged on respective discharge trays.

According to aspects of the disclosures, there is provided a printing apparatus, which has a printing device configured to print an image on a printing sheet, a plurality of trays configured to receive the printing sheet on which image are formed by the printing device, a plurality of sensors respectively provided to the plurality of trays, each of the plurality of sensors outputting signals which are different depending on whether a height of a stack of the printing sheets received by the corresponding tray exceeds a particular height, a conveying device configured to convey the printing sheet inside the printing apparatus, a storage device and a controller. The controller is configured to execute receiving process in which the controller receives a print job associated with a printing operation from an external apparatus, a number of copies obtaining process in which the controller obtains a number of copies to be made for the print job, a sort printing process in which the controller repeatedly causes the printing device to print one page of image of the print job on the number of printing sheets and causes the conveying device to sort and discharge the printing sheets onto respective destination trays among the plurality of trays until all the pages of the print job are processed, a full status determination process in which the controller determines whether a signal output by at least one of the sensors respectively provided to the destination trays is switched, during execution of the sort printing process, from a non-full status signal, which represents the height of the stack of the printing sheets does not exceed the particular height, to a full status signal, which represents the height of the stack of the printing sheets exceeds the particular height, a storing process in which the controller causes the storage device to store the page number of the page currently printed in association with a stack-full tray which is a tray corresponding to the sensor determined in the full status determination process that the output signal is changed from the non-full status signal to the full status signal when the output signal of the at least one sensors is determined to be changed, a modifying process in which the controller stops discharging the printing sheet to the stack-full tray and reduces the number of copies made in the sort printing process from the number obtained in the number of copies obtaining process to a second number, which is obtained by subtracting the number of full-status trays from the number of copies obtained in the number of copies obtaining process when it is determined in the full status determination process that the signal output by at least one of the sensors is changed a release determination process in which the controller determines whether the signal output by the sensor corresponding to at least one of the stack-full trays is changed from the full status signal to the non-full status signal, an image obtaining process in which the controller obtains image data corresponding to the page associated with the stack-full tray and stored in the storage device in the storing process and the subsequent pages from the external apparatus from which the print job is received when it is determined in the release determination process that the signal output by the sensor corresponding to at least one of the stack-full trays is changed from the full status signal to the non-full status signal, and a reprinting process in which the controller causes the printing device to print images obtained in the image obtaining process with making the tray of which sensor is determined to change the output signal from the full status signal to the non-full status signal the destination tray.

According to aspects of the disclosures, there is provided a sheet discharge method for a printing apparatus, which has receiving step of receiving a print job associated with a printing operation from an external apparatus, a number of copies obtaining step of obtaining a number of copies to be made for the print job, a sort printing step repeatedly causing a printing device of the printing apparatus to print one page of image of the print job on the number of printing sheets and causing a conveying device of the printing apparatus to sort and discharge the printing sheets onto respective destination trays among the plurality of trays until all the pages of the print job are processed, a full status determination step of determining whether a signal output by at least one of sensors respectively provided to the destination trays is switched, during execution of the sort printing process, from a non-full status signal, which represents the height of the stack of the printing sheets does not exceed the particular height, to a full status signal, which represents the height of the stack of the printing sheets exceeds the particular height, a storing step causing a storage device of the printing apparatus to store the page number of the page currently printed in association with a stack-full tray which is a tray corresponding to the sensor determined in the full status determination step that the output signal is changed from the non-full status signal to the full status signal when the output signal of the at least one sensors is determined to be changed, a modifying step in which the controller stops discharging the printing sheet to the stack-full tray and reduces the number of copies made in the sort printing step from the number obtained in the number of copies obtaining step to a second number, which is obtained by subtracting the number of full-status trays from the number of copies obtained in the number of copies obtaining step when it is determined in the full status determination step that the signal output by at least one of the sensors is changed, a release determination step of determining whether the signal output by the sensor corresponding to at least one of the stack-full trays is changed from the full status signal to the non-full status signal, an image obtaining step of obtaining image data corresponding to the page associated with the stack-full tray and stored in the storage device and the subsequent pages from the external apparatus from which the print job is received when it is determined in the release determination step that the signal output by the sensor corresponding to at least one of the stack-full trays is changed from the full status signal to the non-full status signal, and a reprinting step causing the printing device to print images obtained in the image obtaining step with making the tray of which sensor is determined to change the output signal from the full status signal to the non-full status signal the destination tray.

According to aspects of the disclosures, there is provided a printing apparatus, which has a printing device configured to print an image on a printing sheet, a first tray configured to receive the printing sheet on which image is formed by the printing device, a second tray configured to receive the printing sheet on which image is formed by the printing device, a first sensor provided to the first tray and outputs signals which are different depending on whether a height of a stack of the printing sheets accommodated in the first tray exceeds a particular height, a storage device, and a controller. The controller is configured to execute a first sort printing process in response to receipt of a sort print job to generate two copies of N pages of printed sheets, the first sort printing process being a process to print an image of each of first page to N-th page of the print job associated with the sort print job on two sheets and discharge the two sheets onto the first tray and the second tray, respectively: when a signal output by the first sensor is switched, during execution of the first sort printing process, from a non-full status signal, which represents the height of the stack of the printing sheets does not exceed the particular height, to a full status signal, which represents the height of the stack of the printing sheets exceeds the particular height, the controller executes, a storing process in which the controller causes the storage device to store the page number m of the page which is supposed to be output to the first tray in association with the first tray, a second sort printing process to print an image of a page associated with the print job on a sheet and discharge the printed sheet on the second tray, repeatedly, from the m-th page to N-th page. Further, when a signal output by the first sensor is switched, during execution of the second sort printing process, from the full status signal to the non-full status signal, reprinting process in which the controller retrieves the page number m stored in the storing process from the storage device, and prints images of the m-th page to N-th page of the sort print job onto respective sheets which are discharged onto the first tray.

BRIEF DESCRIPTION OF THE ACCOMPANYING DRAWINGS

Figures 4A, 4B, 4C:
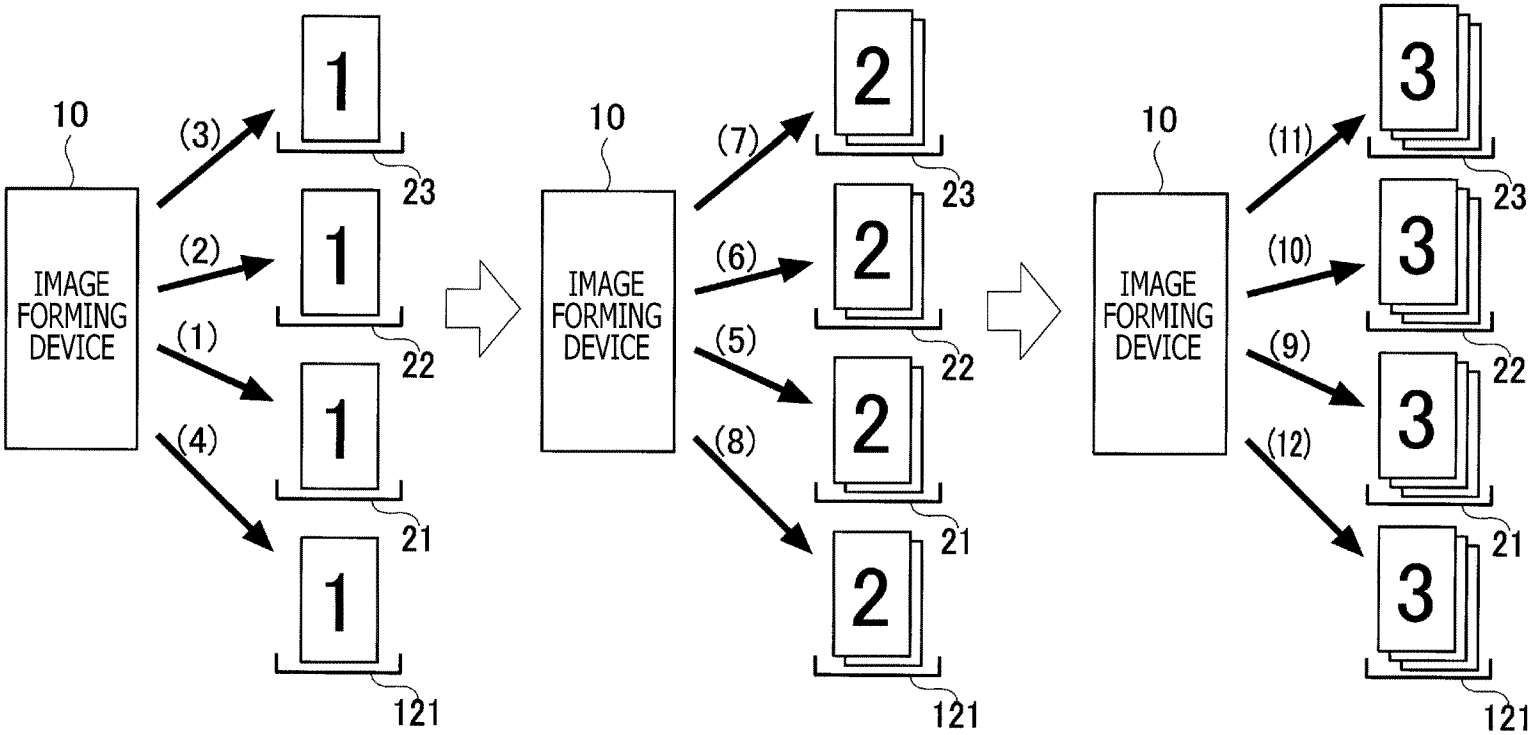

FIGS. 4A-4C schematically illustrate a sort printing according to the illustrative embodiment of the disclosures.

FIGS. 5A-5E illustrate how the sort printing proceeds when a stack full status occurs according to the illustrative embodiment of the disclosures.

Figure 6:
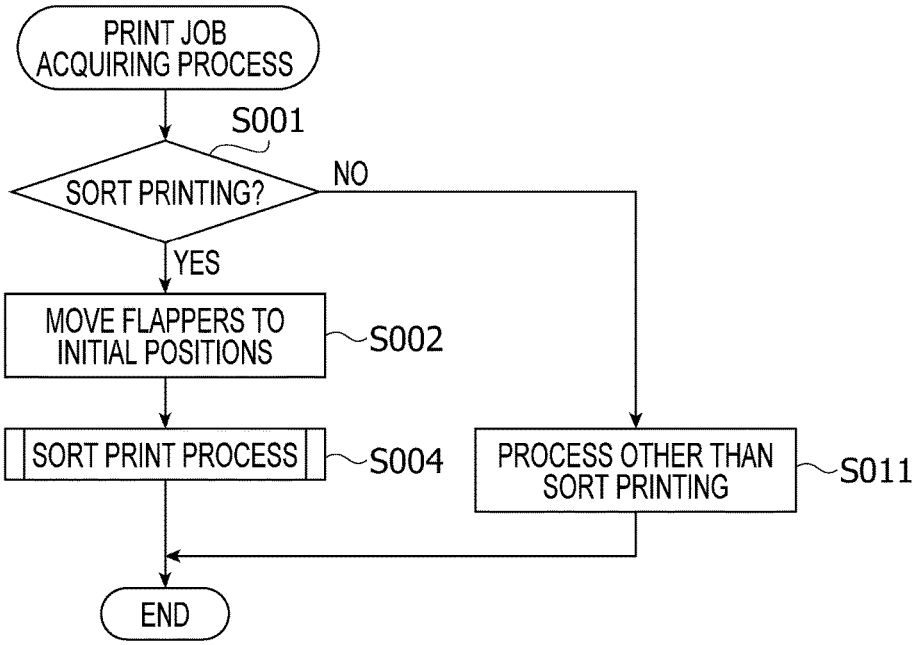

FIG. 6 is a flowchart illustrating a print job acquiring process according to the illustrative embodiment of the disclosures.

Figure 7:
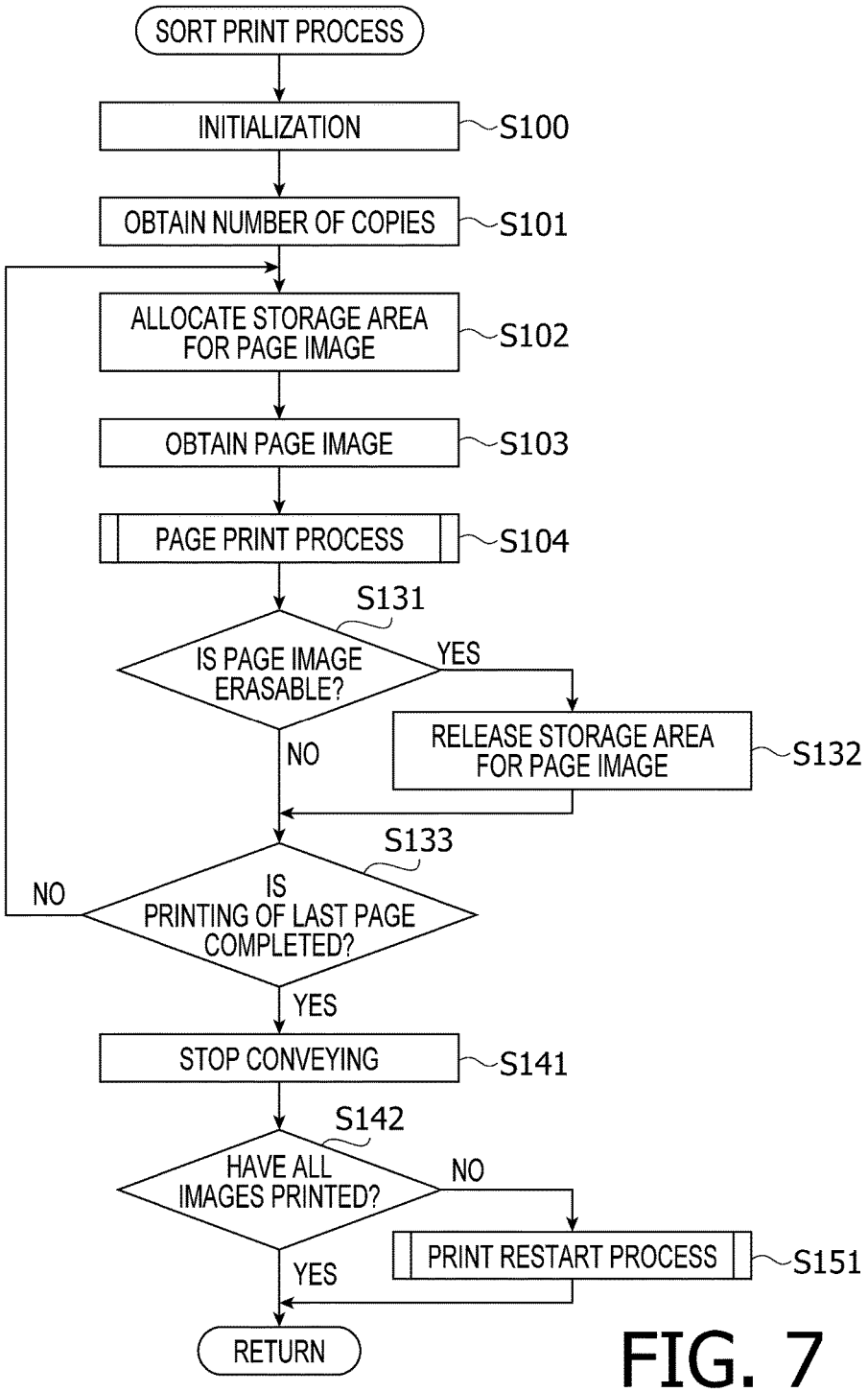

FIG. 7 is a flowchart illustrating a sort printing process according to the illustrative embodiment of the disclosures.

Figure 8:
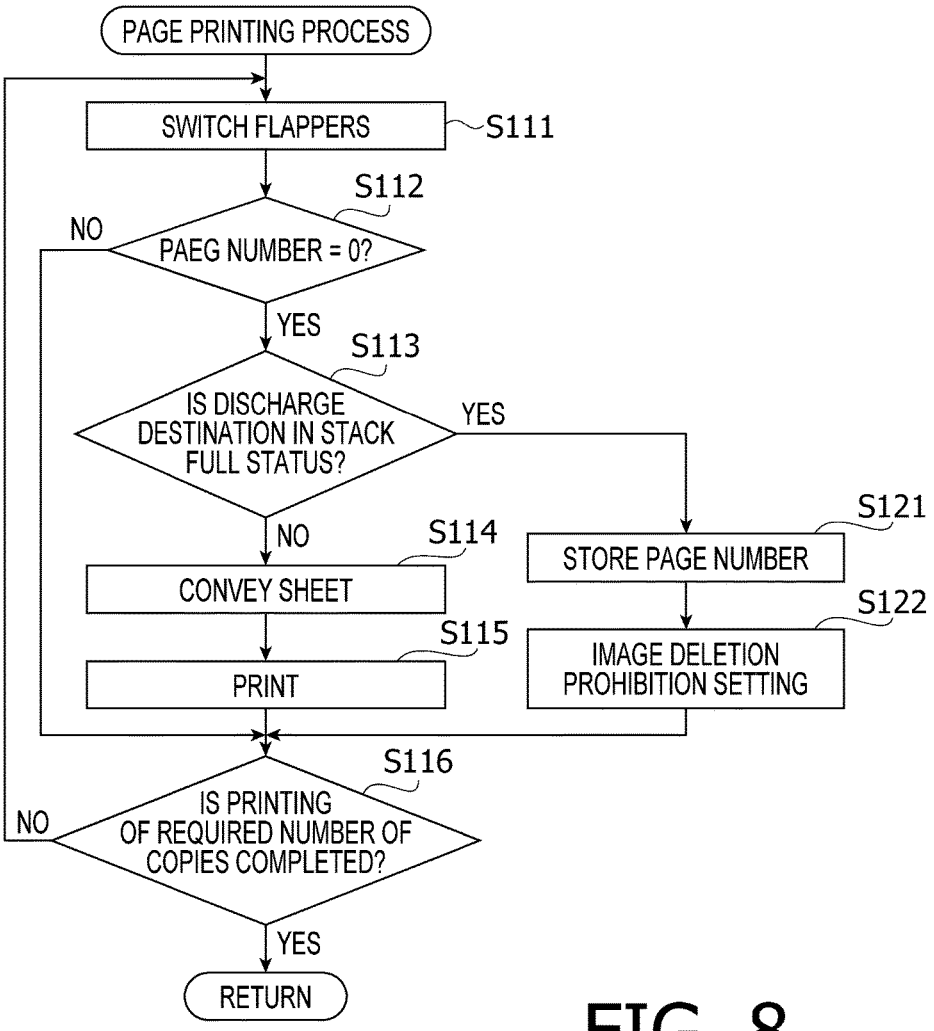

FIG. 8 is a flowchart illustrating a page printing process according to the illustrative embodiment of the disclosures.

Figure 9:
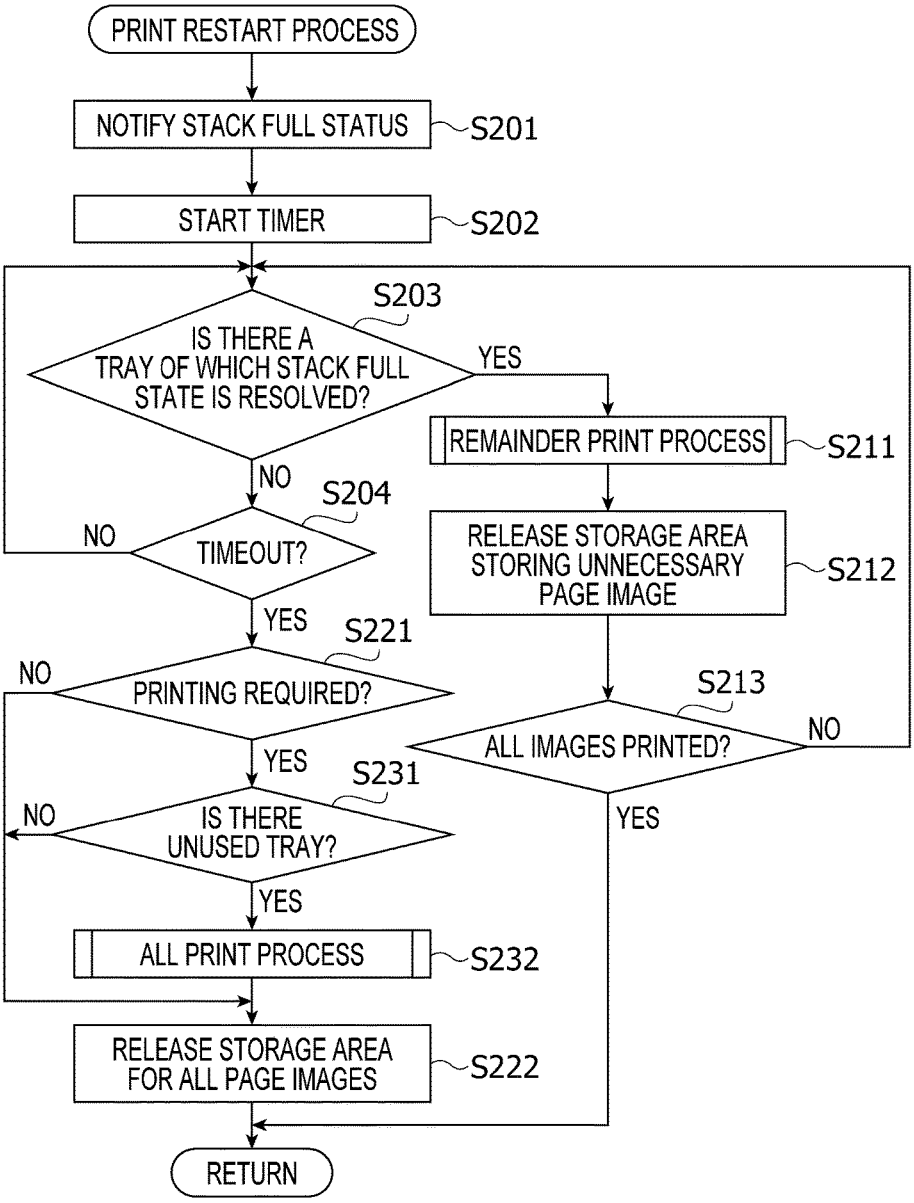

FIG. 9 is a flowchart illustrating a print restart process according to the illustrative embodiment of the disclosures.

Figure 10:
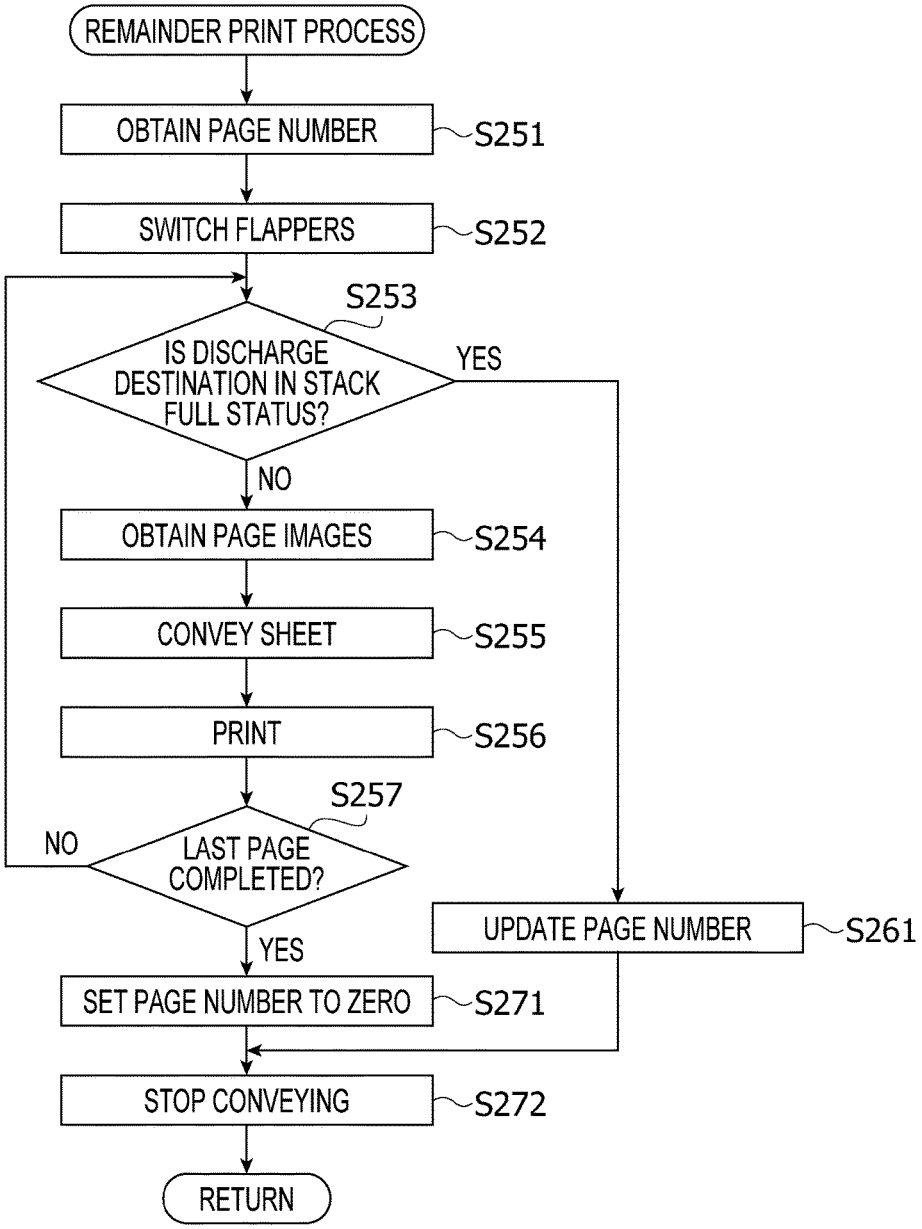

FIG. 10 is a flowchart illustrating a remainder print process according to the illustrative embodiment of the disclosures.

Figure 11:
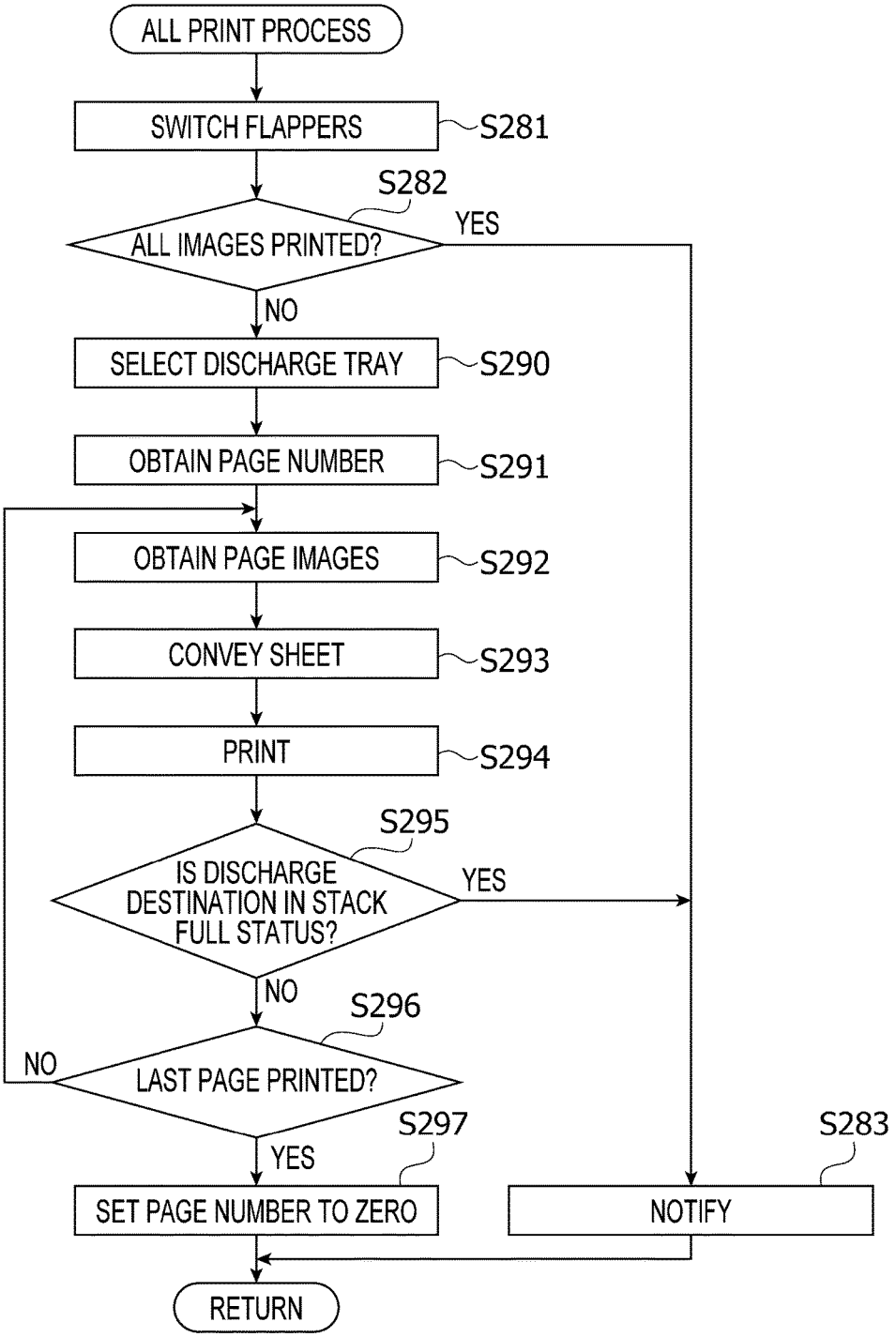

FIG. 11 is a flowchart illustrating an all print process according to the illustrative embodiment of the disclosures.

DETAILED DESCRIPTION OF THE EMBODIMENT

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

Hereinafter, referring to the accompanying drawings, a printer 100 according to an illustrative embodiment of the disclosures will be described.

<Configuration of Printer>

Figure 1:
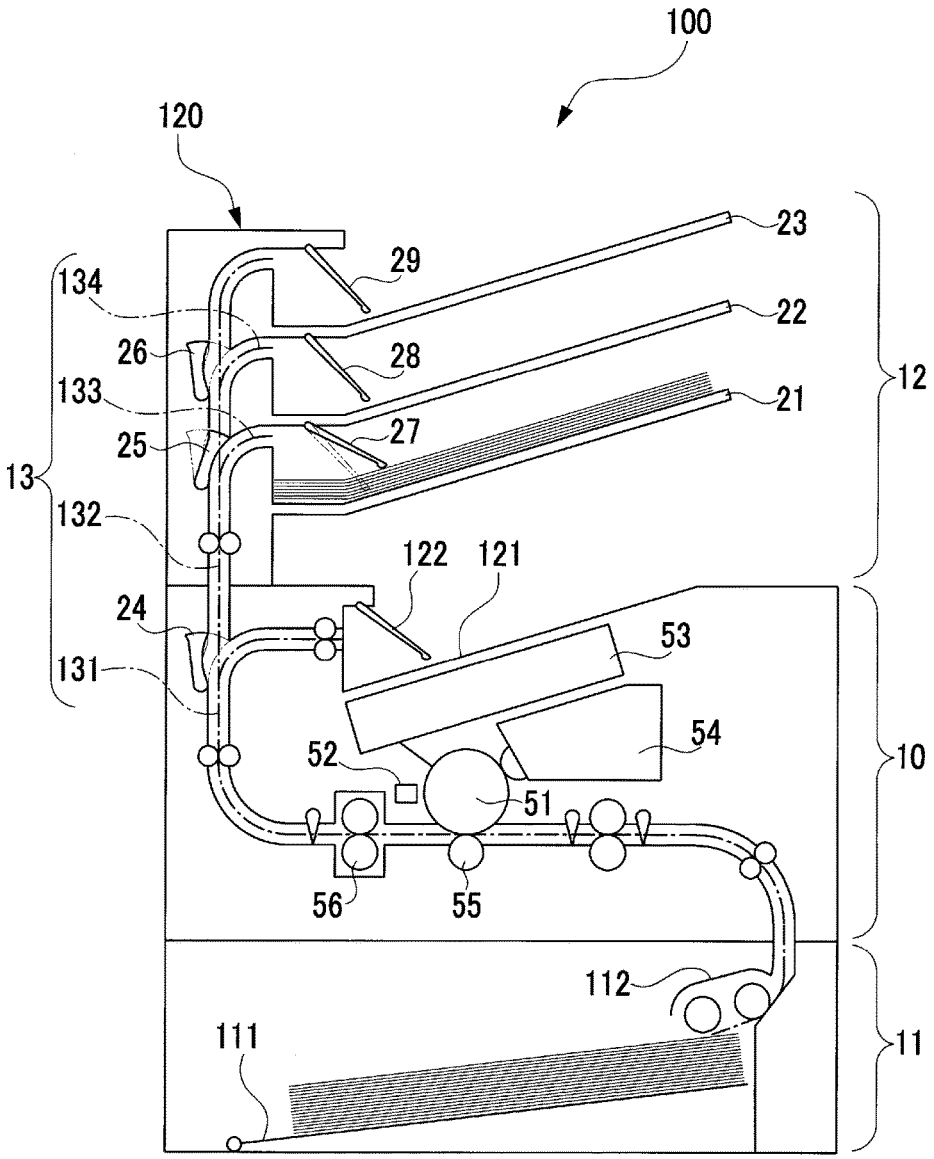
FIG. 1 is a cross sectional side view of a printer according to an illustrative embodiment of the disclosures.

The printer 100 has an image forming device 10 configured to form an image on printing sheet, a sheet feeder 11 configured to accommodate multiple printing sheets, which are unprinted sheets, and separate one printing sheet from the other and feed the separated printing sheet to the image forming device 10, and a discharged sheet container 12 configured to accommodate the printing sheets after images are formed thereon (see FIG. 1). Further, inside the printer 100, a sheet conveying passage 13, which is a passage of the printing sheet extending from the sheet feeding device 11 to the discharged sheet container 12 via the image forming device 10, is formed. In FIG. 1, the printing sheet is conveyed generally in an upward direction.

According to the illustrative embodiment, the printer 100 is configured to form images on the printing sheets according to an electrophotographic image forming method. The image forming device 10 has, as shown in FIG. 1, a photosensitive body 51, a charging device 52, an exposure device 53, a developing device 54, a transfer device 55 and a fixing device 56. The image forming device 10 is an example of a printing device set forth in claims.

When images are formed, the printer 100 operates such that a surface of the photosensitive body 51 is charged by the charging device 52, and the charged surface of the photosensitive body 51 is exposed to light emitted by the exposure unit 53, thereby an electrostatic latent image based on print data is formed on the surface of the photosensitive body 51. Then, the developing device 54 supplies toner onto the electrostatic latent image, thereby forming a toner image on the surface of the photosensitive body 51. Next, by actuating the transfer device 55, the toner image is transferred from the photosensitive body 51 to the printing sheet which is being conveyed between the photosensitive body 51 and transfer device 55. Thereafter, the toner image transferred onto the printing sheet is fixed thereon with use of the fixing device 56.

The sheet feeding device 11 has, as shown in FIG. 1, a sheet feed tray 111 and a sheet separation device 112. The sheet feeding device 11 is configured to separate one printing sheet from the printing sheets accommodated in the sheet feeding tray 111 and feed the separated one printing sheet to the sheet conveying passage 13. It is noted that the printer 100 shown in FIG. 1 has one set of sheet feeding tray 111 and the sheet separation device 112, but the printer may be configured to a plurality of sets of the sheet feeding tray and the sheet separation device.

The discharged sheet container 12 is configured to accommodate the printing sheets on which images have been formed by the image forming device 10, and has a main body tray 112, which is a discharge tray provided to a main body of the printer 100, and a mail box 120 which is constituted by a group of discharge trays (i.e., multiple discharge trays) extended to the main body. The main body tray 121 is formed on an upper outer surface of a casing of the image forming device 10. The mail box 120 is attached on an upper part of the image forming device 10. The main box 120 according to the illustrative embodiment has three stages of discharge trays. That is, the mail box 120 contains a lower stage tray 21, a middle stage tray 22 and an upper stage tray 23. It is noted that each of the main body tray 121, the lower stage tray 21, the middle stage tray 22 and the upper stage tray 23 is an example of the tray set forth in the claims.

Thus, the printer 100 has four trays each of which can be a discharge destination of the printing sheet on which an image has been printed. The printer 100 is configured to discharge each of the printing sheets to the discharge tray designated in a print job or determined by the printer 100 in a sorted manner. In order to sort printing sheets and discharge the same to respective discharge trays, the sheet conveying passage 12 includes multiple branched passages and multiple flappers arranged at respective branching points of the sheet conveying passage 12. Each flapper is configured to be rotatable between an open position at which the flapper opens an entrance of one of the branched passages at the branching point and a close position at which the entrance of the one of the branched passages at the branching point is closed. In FIG. 1, for each of the flappers, a left-hand side is the open position and a right-hand side is the close position. The printer 100 discharges each printing sheet to the designated accommodating position by controlling the positions of respective flappers.

For example, a main body flapper 24 is arranged at a branching point where a sub passage 132 conveying the printing sheet toward the mail box 120 is branched from a main passage 131. When the main body flapper 24 is located, as shown by slid line in FIG. 1, to an open position, which is a leftward position to open the entrance to the sub passage 132, the printing sheet proceeds to the sub passage 132 at the branching point. When the main body flapper 24 is located, as shown by two-dotted lines in FIG. 1, to a close position, which is a rightward position to close the entrance to the sub passage 132, the printing sheet proceeds along the main passage 131 and is discharged onto the main body tray 121.

A lower stage flapper 25 is arranged at a branching point where a branching passage 133 extending toward the lower stage tray 21 is branched from the sub passage 132 (see FIG. 1). That is, the branching passage 133 is branched from the sub passage 132 at a position below the lower stage flapper 25. A middle stage flapper 26 is arranged at a position where a branching passage 134 extending toward the middle stage tray 22 is branched from the sub passage 132. That is, the branching passage 134 is branched from the sub passage 132 at a position of the middle stage flapper 25. Each of the lower stage flapper 25 and the middle stage flapper 26 is configured to open/close entrances to the sub passage 132.

When the printing sheet is directed to a certain tray, the printer 100 causes all the flappers arranged on an upstream side with respect to the branching point corresponding to the certain tray to be located on the open positions, and then causes the flapper at the branching point corresponding to the certain tray to be located on the close position. That is, when the printing sheet is to be discharged onto the lower stage tray 21, the printer 100 causes the lower stage flapper 25 to be located to the close position. When the printing sheet is to be discharged onto the middle stage tray 22, the printer 100 causes the middle stage flapper 25 to be located at the close position. It is noted that, when all the flappers are located at the open positions, the printing sheet is discharged onto the upper stage tray 22 which is arranged at an end of the sub passage 132.

FIG. 1 shows a status where the flappers 24-26 are located at respective positions when the printing sheet is to be discharged on the lower stage tray 21. Specifically, the main body flapper 24 is located at the open position, and the lower stage flapper 25 is located at the close position. According to this arrangement, the printing sheet is proceeds from the main body flapper 24 to the sub passage 132, then proceeds to the branched passage 133 extending toward the lower stage tray 21 by the lower stage flapper 25, and discharged onto the lower stage tray 21. It is noted that the middle stage flapper 25 is located at the open position in FIG. 1, but may be located at the close position.

Further, stack sensors 27-29 and 122 are provided to the discharge trays 21-23 and 121, respectively. Each of the stack sensors 27-29 and 121 is configured to output different signals depending on whether the height of the stacked printing sheets is higher than a particular height or not. In the following description, a term "sheet height" is used to express the height of the stack of printing sheets accommodated in each discharge tray.

The particular height is a height closer to and lower than the maximum height when the maximum number of printing sheets are stacked in each discharge tray. In other words, the height of the printing sheets may reach the maximum height when a few printing sheets are discharged on to the discharge sheet tray. When the printing sheets are discharged onto the discharge sheet tray such that the sheet height exceeds the maximum height, the printing sheets having been stacked may be pushed out by newly discharged printing sheets, the printing sheets may be broken, or the discharge opening may be jammed. To avoid such problems, when it is determined that the sheet height is higher than the particular height (i.e., the sheet height is close to the maximum height) based on the output of each of the stack sensors 27-29 and 121, discharging of the printing sheets on to the discharge tray of which the sheet height is higher than the particular height is stopped. It is noted that different particular heights may be defined for different discharge trays 21-23 and 121, respectively.

As shown in FIG. 1, the printer 100 has a lower stage stack sensor 27 provided to the lower stage tray 21, a middle stage stack sensor 28 provided to the middle stage tray 22, an upper stage stack sensor 29 provided to the upper stage tray 23, and a main body stack sensor 122 provided to the main body tray 121. It is noted that each of the lower stage stack sensor 27, the middle stage stack sensor 28, the upper stage stack sensor 29 and the main body stack sensor 122 is an example of a sensor set forth in the claims.

Figure 2:
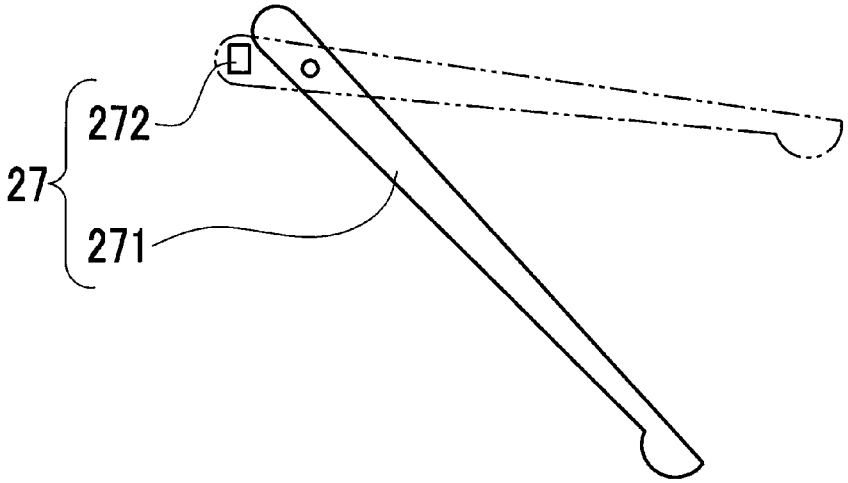
FIG. 2 illustrates an example of a stack sensor according to the illustrative embodiment of the disclosures.

According to the illustrative embodiment, the lower stage stack sensor 27 has a rotatable piece 271 which is rotatably attached at an upper part within an accommodation space of the lower stage tray 21, and a light transmission sensor 272 configured such that a light path is blocked when the rotatable piece 271 is rotated by a particular angle or more. When the sheet height of the lower stage tray 21 has not reached the particular height, the rotatable piece 271 of the lower stage stack sensor 27 is located by its own weight at a position where the rotatable piece 271 does not block the light path as indicate by solid line in FIG. 2. In this state, the lower stage stack sensor 27 outputs a signal representing that the sheet height of the lower stage tray 21 is not higher than the particular height. Such a signal will be referred to as "a non-stack full signal" hereinafter.

When the printing sheets are accommodated in the lower stage tray 21, the rotatable piece 271 is rotated as an end of the rotatable piece 271 is pushed up by the printing sheets. When the sheet height of the lower stage tray 21 becomes higher than the particular height, the rotation angle of the rotatable piece 271 becomes greater than the particular angle, and by the other end of the rotatable piece 271, the light path of the light transmission sensor 272 is blocked as indicated by the two-dotted line in FIG. 2. In this state, the lower stage stack sensor 27 outputs a signal representing that the sheet height is higher than the particular height. Such a signal will be referred to as "a stack full signal" hereinafter. Further, a status where the stack full signal is output at a timing other than the printing sheet is being discharged will be referred to as a "stack full status" hereinafter.

It is noted that the middle stage stack sensor 28, the upper stage stack sensor 28 and the main body stack sensor 122 has the same configuration as the lower stage stack sensor 27. It is also noted that the sheet heights at which the output signals of the stack sensors 27-29 and 122 change are particular heights set to respective trays.

<Electrical Configuration of Printer>

Figure 3:
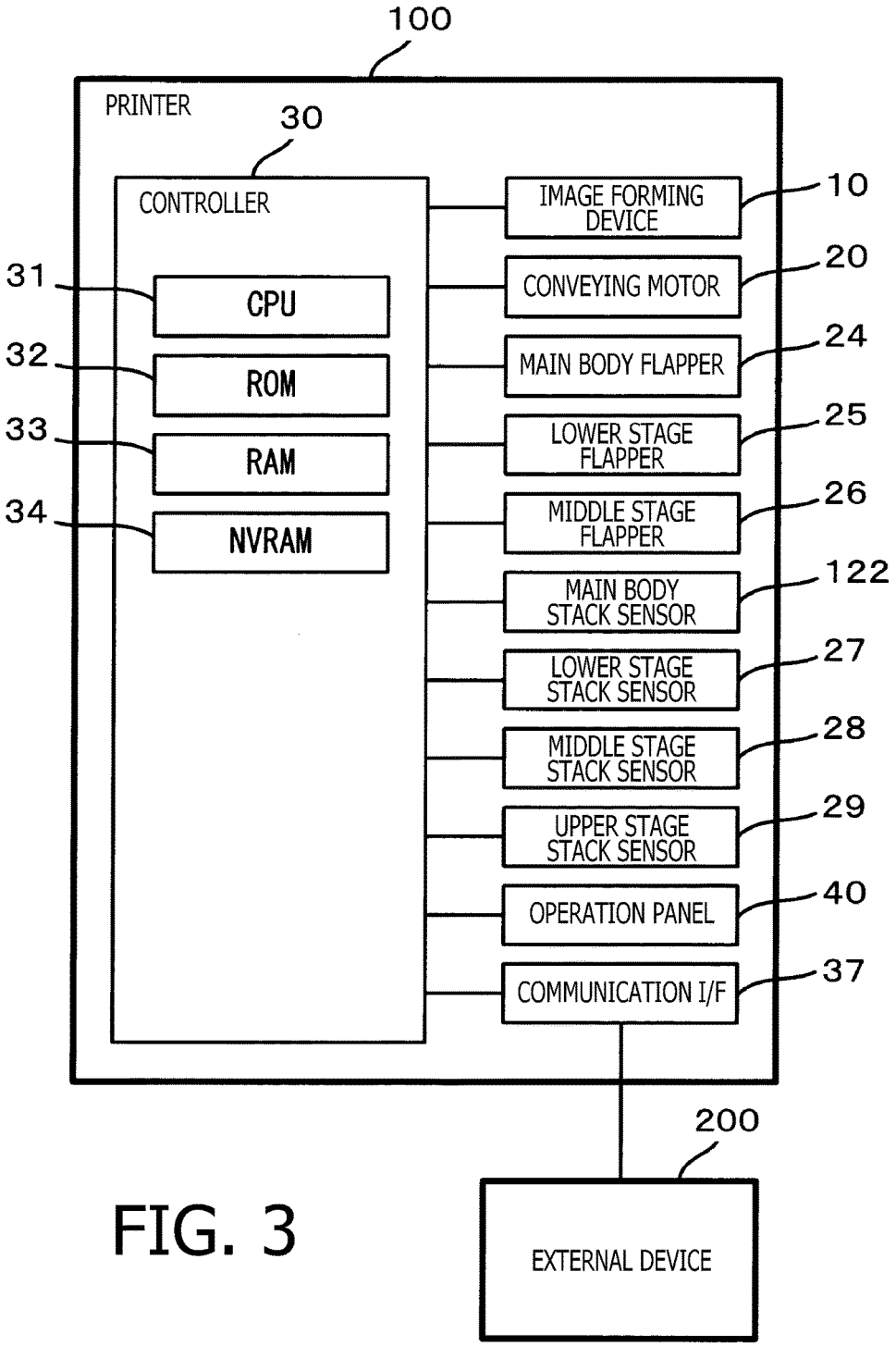
FIG. 3 is a block diagram showing an electrical configuration of the printer according to the illustrative embodiment of the disclosures.

The printer 100 has a controller 30 which includes a CPU (central processing unit) 31, a ROM (read only memory) 32, a RAM (random access memory) 33, and an NVRAM (non-volatile RAM) 34 as shown in FIG. 3. Further, the printer 100 has the image forming device 10, a conveying motor 20, the flappers 24-26, the stack sensors 27-29, 122, a communication I/F (interface) 37 and an operation panel 40, which are electrically connected to the controller 30.

The ROM 32 stores control programs, setting values, initial values and the like used to control the printer 100. The RAM 33 and the NVRAM 34 are used as work areas when control programs are retrieved from the ROM 32 and/or temporary storage areas to temporarily store data. It is note that the RAM 33 is an example of a storage set forth in the claims.

The CPU 31 controls respective components of the printer 100 based on the control programs retrieved from the ROM 32 with storing processing results in the RAM 33 or the NVRAM 34. It is noted that the CPU 31 is an example of a controller set forth in the claims. It is noted that the controller 30 itself is the controller set forth in the claims. It is further noted that the controller 30 shown in FIG. 3 is a collective name including hardware used to control the printer 100 (e.g., the CPU 31) and the term controller 30 need not to indicate a single piece of hardware.

The conveying motor 20 serves as a driving source of respective rollers which are used to convey the printing sheet when the printing sheet accommodated in the sheet feeding device 11 is conveyed to the destination tray via the image forming device 10. It is noted that the conveying motor 20 may also serve as a driving source of other rotating components such as the photosensitive body 51, a developing roller of the developing device 54, a transfer roller of the transfer device 55, a fixing roller of the fixing device 56 and the like.

The communication I/F 37 is hardware used to communicate with an external device 200. A communication method employed in the communication I/F 37 is either wired or wireless. When the wired communication is employed, the communication I/F 37 may be a serial I/F to execute a serial communication and may be a USB (universal serial bus) cable and the like, a network I/F used to connect with a network such as the Internet, or a modem (modulator and demodulator) to connect with a public telephone network. The external device 200 may be a personal computer, a mobile device such as a smartphone or a facsimile machine.

The operation panel 40 has an LCD (liquid crystal display) and a button group including a start key, a stop key, ten keys and the like, and functions to notify message to a user and acquire instructions input by the user.

<General Description of Sort Printing>

According to a sort printing, an operation to print multiple copies of an image for one page and the printing sheets on which the images are printed are discharged to the discharge trays corresponding to the number of multiple copies among the discharge trays 21-23 and 121 in a sorted manner is repeated by the number of pages. That is, the printer 100 discharge the printing sheet to one of the discharge tray 21-23 and 121, switches the discharge destination to another one of the discharge trays 21-23 and 121 and discharge another printing sheet, and repeats the same in accordance with discharging order corresponding to the number of copies to be made. It is noted that, when the sort printing is executed, setting of the number of copies exceeding the number of the discharge trays is treated as an error.

FIGS. 4A-4C show discharge of the printing sheets when a print job to print four copies of the images for three pages is received. For the same page, it is assumed that the discharging order is the lower stage tray 21, the middle stage tray 22, the upper stage tray 23 and the main body tray 121. This discharge order may be preliminarily stored in the ROM 32 of the printer 100, the user may set through the operation panel 40, or included in the print job. Thus, the discharge order may be either fixed of variable.

When the print job is started, if the lower stage tray 21 is not in the stack full state, conveying of the sheet is executed with the lower stage tray 21 being the discharge destination and the first page of the print job is executed (FIG. 4A(1)). Then, the printer 100 switches the discharge tray, according to the particular discharge order, to the middle stage tray 22 if it is not in the stack full state and conveys the printing sheet and printing of the first page is executed (FIG. 4A(2)). Next, the printer 100 switches the discharge tray, according to the particular discharge order, to the upper stage tray 23 if it is not in the stack full state and conveys the printing sheet and printing of the first page is executed (FIG. 4A(3)). Further, the printer 100 switches the discharge tray, according to the particular discharge order, to the main body tray 121 if it is not in the stack full state and printing of the first page is executed (FIG. 4A(4)).

Next, as shown in FIG. 4B, the printer 100 executes printing of the second page according to the particular discharge order. If the lower stage tray 21 is not in the stack full state, the printer 100 switches the discharge tray to the lower stage tray 21, conveys the printing sheet and executes printing of the second page (FIG. 4B(5)). Similarly, printing of the other copies of the second page is executed and discharged to the middle stage tray 22, the upper stage tray 23 and the main body tray 121, respectively.

Similarly, as shown in FIG. 4C, the printer 100 executes printing of the third page according to the particular discharge order. That is, printing of the four copies of the third page is executed and discharged to the lower stage tray 21, the middle stage tray 22, the upper stage tray 23 and the main body tray 121, respectively (FIG. 4C(9), (10), (11) and (12)). After the above-described process, on each of the discharge trays 21-23 and 121, first through third pages of the images are discharges in the order of the pages.

FIGS. 5A-5E show a case where the four copies of the images for three pages are to be printed but the upper stage tray 23 becomes in a stack full state when the first page is discharged onto the upper stage tray 23.

Printing of the first page is executed similarly to a case shown in FIG. 4A. That is, the four copies of the first page are discharged to the lower stage tray 21, the middle stage tray 22, the upper stage tray 23 and the main body tray 121, which are switched according to the particular discharge order (FIG. 5A(1), (2), (3) and (4)).

Figures 5A, 5B, 5C, 5D, 5E:
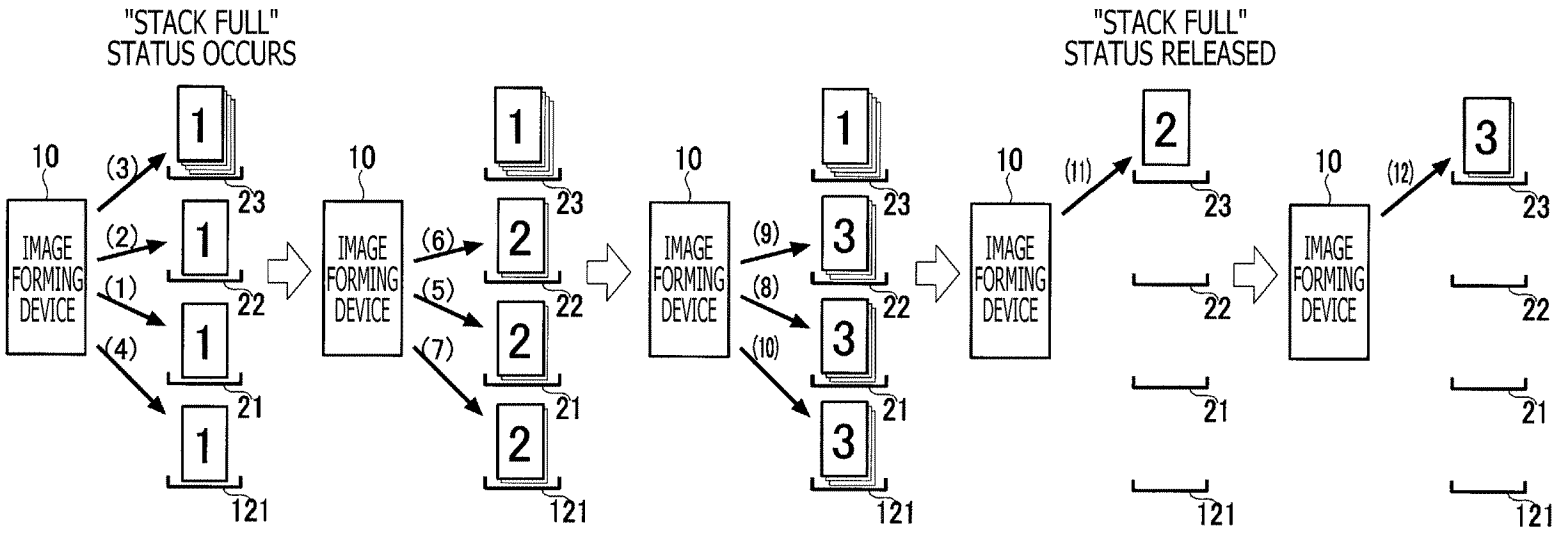

Next, the printer 100 executes printing of the second page and discharge two copies of the second page to the lower stage tray 21 and the middle stage tray 22 by switching the discharge trays (FIG. 5B(5) and (6)). According to the particular discharge order, the printer 100 is to print the second page which is to be discharged to the upper stage tray 23. However, the upper stage tray 23 is in the stack full status, and the printer 100 cannot discharge the second page to the upper stage tray 23. Therefore, the printer 100 skips printing of the second page and discharging of the same onto the upper stage tray 23. That is, the printer 100 switches the discharge tray to the main body tray 121, conveys the printing sheet and executes printing of the second page (FIG. 5B(7)). That is, the number of copies of the second page and the number of discharge destinations of the second page is less than those of the first page by one.

Next, the printer 100 executes printing and discharging of the third page by selecting the lower stage tray 21, the middle stage tray 22 and the main body tray 121 in this order similar to the process for the second page, with skipping the upper stage tray 23 and skipping printing of the third page for the upper stage tray 23 (FIG. 5C(8), (9) and (10)). With this control, on the discharge trays 21, 22 and 121, which are not in the stack full status, first through third pages of the printing sheets are stacked in this order. Thereafter, the printer 100 awaits that the printing sheets stacked on the upper stage tray 23 are removed.

When the printing sheets are removed from the upper stage tray 23 and the stack full status of the upper stage tray 23 is released, the printer 100 starts printing of unprinted pages. That is, as shown in FIG. 5D, the printer 100 starts conveying the printing sheet with the upper stage tray 23 being the discharge destination, and executes printing of the second page (FIG. 5D(11)). Further, as shown in FIG. 5E, the printer 100 executes printing of the third page (FIG. 5E(12)). With the above process, on the upper stage tray 23, which was in the stack full status, the remainder pages after the upper stage tray 23 became the stack full status are printed and discharged onto the upper stage tray 23, thereby the first through third pages of the printing sheets are stacked in this order on the upper stage tray 23.

<Print Job Acquiring Process>

A print job acquiring process which includes a process of the above-described sort printing will be described with reference to the flowchart shown in FIG. 6. The print job acquiring process is executed by the CPU 31 of the controller 30 in response to receipt of a print job. It is noted that a process of acquiring a print job, which is a triggering condition of the print job acquiring process, is an example of an acquiring process set forth in the claims.

It is note that the printer 100 may acquire a print job via the communication IIF 37, received from the external device 200, or acquire user input operation through the operation panel 40. In the following description, it is assumed that a default order of the discharge destination of the trays is the lower stage tray 21, the middle stage tray 22, the upper stage tray 23 and the main body tray 121, and that the default order is stored in the NVRAM 34.

In the print job acquiring process, the controller 30 determines whether the sort printing is to be executed (S001). Whether the sort printing is to be executed may be determined based on a setting stored in the NVRAM 34, which setting may be preliminarily input by the user through the operation panel 40, or based on the setting included in the print job if such a setting is included.

When the sort printing is not executed (S001: NO), the controller 30 executes a printing operation other than the sort printing (S011). It is noted that the printing operations other than the sort printing are conventionally known operations and description thereof will be omitted for brevity. It is noted that examples of the printing operations other than the sort printing are a stack printing in which printing sheets are continuously discharged on a particular discharge tray, and a printing operation of a print job in which the number of copies is not designated. After execution of S001, the print job acquiring process is terminated.

When the sort printing is executed (S001: YES), the controller 30 causes each of the flappers 24, 25 and 26 to be set to the opened status (S002). After execution of S002. the controller 30 executes a sort printing process (S004).

FIG. 7 shows the sort printing process. In the sort printing process, the controller 30 initializes information used in the sort printing (S100). For example, the controller 30 allocates an area to store page number information for respective discharge trays in the RAM 33, and initializes the page number included in the respective pieces of the page number information to zero. The page number information is used to determine whether conveyance of the printing sheet is stopped, and to determine the page number when printing is restarted with respect to the corresponding discharge tray. Further, the controller 30 allocates an area storing image deletion prohibition flag, which is a flag to prohibit release of a storage area storing the image data, and initializes the image deletion prohibition flag to OFF.

After execution of S100, the controller 30 obtains the number of copies, which is set to the print job (S101). It is noted S101 is an example of a number of copies obtaining process set forth in the claims.

After S101, the controller 30 allocates a storage area to store the image data in the RAM 33 (S102). Then, the controller 30 obtains the image data subject to print on a page basis (S103). For example, when the print job is started, the controller 30 obtains the image data for the first page. The thus obtained image data is stored in the storage are allocated for storing the image data in S102. Then, the controller 30 executes printing the copies of the image by the number obtained in S101 based on the image represented by the image data obtained in S103, and executes the page printing process to sort the printing sheets to respective discharge trays (S104).

FIG. 8 shows the page printing process which is called in S104 in FIG. 7. In the page printing process, the controller 30 switches the respective flappers (S111) in accordance with the order of the discharge destinations so that the printing sheets are conveyed to the respective discharge trays. For example, when the print job is started, the first order discharge tray among the multiple discharge trays is determined as the discharge destination. According to the illustrative embodiment, the first discharge tray is the lower stage tray 21. Therefore, the controller 30 initially sets the main body flapper 24 to be located at the open position, and the lower stage flapper 25 to be located at the close position.

After execution of S111, the controller 30 retrieves the page number information corresponding to the discharge tray which is the discharge destination, and determines whether the page number included in the page number information is zero (S112). It is noted that the initial value of the page number included in the page number information is zero, and the page number when the discharge tray becomes in the stack full status is stored. That is, if the page number included in the page number information is zero, it is determined that the discharge tray is not in the stack full status, which the page number is a number other than zero, it is determined that the discharge tray is in the stack full status.

When the page number included in the page number information is zero (S112: YES), the controller 30 determines whether the destination discharge tray is in the stack full status, that is, whether the stack full signal is output from the stack sensor corresponding to the destination discharge tray (S113). It is noted that S113 is an example of a full status determination process set forth in the claims.

If the destination discharge tray is not the stack full status (S113: NO), the controller 30 instructs a conveying system including the conveying motor 20 to execute conveying the printing sheet, and starts conveying the printing sheet (S114). Further, the controller 30 causes the image forming device 10 to form the image represented by the image data obtained in S103, that is, causes the image forming device 10 to print the image represented by the image data obtained in S103. The printing sheet on which the image is printed is discharged to the destination discharge tray.

If the destination discharge tray is in the stack full status (S113: YES), the controller 30 stores the page number of the image data currently processed in a storage area of the page number, of the page number information, corresponding to the destination discharge tray (S121). It is noted that S121 is an example of a storage process set forth in the claims. Further, the controller 30 sets the image deletion prohibition flag to be "ON" (S122).

After execution of S115 or S112, or when the page number included in the page number information is other than zero (S112: NO), the controller 30 determines whether the necessary number of copies printing has been completed (S116). When the designated number of copies of images have not been printed (S116: NO), the controller 30 returns to S111, and executes steps S112 onwards, with switching respective flappers so that the printing sheet is conveyed to the next destination discharge tray based on the order of the destination discharge tray. When the designated number of copies have been made (S116: YES), the controller 30 terminates the page printing process.

That is, in the page printing process, when the discharge destination tray is not in the stack full status, the controller 30 conveys the printing sheet to the discharge destination tray with printing the currently processed page. When the discharge destination tray is in the stack full status, the controller 30 skips conveying the printing sheet to the discharge destination tray and printing the currently processed image on the printing sheet. Further, when a certain discharge tray is in the stack full status, a number other than zero is stored as the page number of the page number information corresponding to the destination discharge tray in the stack full status. Therefore, in the page printing process regarding the image data of the next page, determination at S112 is "NO" and conveying and printing of the sheet directed to the discharge destination tray in the stack full status is skipped. That is, the number of occurrences of page printing operations is less than the number of copies obtained in S101. It is noted that S112 and S121 are examples of a modifying process set forth in the claims.

It is noted that, even if the printing sheets are removed from the discharge tray after it is in the stack full status and the stack full status of the discharge tray is released, a number other than zero is stored as the page number in the page number information. Therefore, with respect to the discharge tray of which the stack full status was detected, conveying the printing sheet to the discharge tray and printing onto the sheet are skipped regardless of the status of the discharge tray thereafter until all the pages of the page printing process is completed. That is, it is avoided that the printing sheets having a different order of page numbers are discharged on the discharge tray.

In FIG. 7, after execution of S104, the controller 30 determines whether the image data obtained in S103 can be erased (S131). When at least one of the discharge trays becomes in the stack full status when the page printing process is executed, the image deletion prohibition flag is set to "ON" in S112. Therefore, when the image deletion prohibition flag is "ON," it can be assumed that printing of the designated number of copies has not been completed, and the controller 30 determines that deletion of images is prohibited. In contrast, if the image deletion prohibition flag is set to be "OFF," it can be assumed that printing of the designated number of copies have been completed, and the controller 30 determines that deletion of the images can be done. When the images can be deleted (S131: YES), the controller 30 releases the storage area of the image data obtained in S103 (S132).

After execution of S132 or when it is determined that the images cannot be deleted (S!31: NO), the controller 30 determines whether the page printing process at S103 has been completed with respect to the image data for the last page of the print job (S133). When it is determined that the page printing process at S103 with respect to the has not been completed (S103: NO), the controller 30 returns to S102, allocates the next storage area for the next page of the image data, and executes steps S103 onwards. It is noted that a process from S102 to S133 is an example of the sort printing process.

When the page printing process at S104 has been completed with respect to the image data of the last page (S133: YES), the controller 30 instructs the conveying system to stop conveying the printing sheet (S141).

After execution of S141, the controller 30 determines whether printing of designated number of copies of the images of all the pages of the print job has been completed (S142). If there is a discharge tray, for which discharging of one or more printing sheets was skipped, the image deletion prohibition flag is set to "ON" and the page number of the page number information corresponding to the discharge tray is set to a number other than zero. Therefore, when the image deletion prohibition flag is set to "ON" or there is page number information including the page number which is set to a number other than zero, it is determined that printing of the print job has not been completed. In contrast, when the image deletion prohibition flag is set to "OFF" or there is no image information including the page number which is set to a number other than zero, it could be determined that printing of the print job has been completed.

When printing of the designated number of copies of all the pages of the images of the print job has been completed (S142: YES), the controller 30 terminates the sort print process. When printing of the designated number of copies of all the pages of the images of the print job has not been completed (S142: NO), the controller 30 executes a print retard process in which unprinted portion of the print job is printed (S151).

In the print restart process shown in FIG. 9, the controller 30 notifies an error message which indicates that the discharge tray is in the stack full status and/or it is necessary to remove the printing sheets from the discharge tray (S201). A notifying method is to display a message on the operation panel 40, or output a voice guidance. Alternatively or optionally, a signal representing that an error occurs may be transmitted to the external device which is a sender of the print job.

After execution of S201, the controller 30 starts a timer to measure waiting time until the stack full status is released (S202).

After execution of S202, the controller 30 determines whether there is a discharge tray of which stack full status is released (S203). Regarding the discharge tray which became in the stack full status, the page number of the corresponding page number information is set to the number other than zero. In S203, it is determined that, in such a discharge tray, whether the stack full status is released, that is a non stack full signal is output from the stack sensor corresponding to such a discharge tray. It is noted S203 is an example of a release determination process set forth in the claims.

If there are no discharge trays which were in the stack full status and the stack full status thereof has been released (S203: NO), the controller 30 determines whether a timeout occurs (i.e., the stack full status of none of the discharge trays which were in the stack full status has released and a predetermined time has passed since, for example, the user has not removed the printing sheets from such a tray)(S204). According to the illustrative embodiment, when a measured time of the timer exceeds a particular time, it is determined that the timeout has occurred. When it is determined that the timeout has not occurred (S204: NO), the controller 30 returns to S203 and repeats determining whether there is a discharge tray of which stack full status is released and occurrence of the timeout.

Where it is determined that there is a discharge tray of which the stack full status is released (S203: YES), the controller 30 executes a remainder print process, in which unprinted pages of the images are printed, regarding the tray detected in S203.

In the remainder print process shown in FIG. 10, the controller 30 obtains the page number contained in the page number information corresponding to the discharge tray of which the stack full status has been released (S251). Further, the controller 30 switches the positions of the flappers so that the printing sheets can be conveyed to the discharge tray of which the stack full status has been released.

After execution of S252, the controller 30 determines whether the destination discharge tray is in the stack full status (S253). When it is determined that the destination discharge tray is not in the stack full status (S253: NO), the controller obtains, in S254, image data corresponding to the page number obtained in S251. It is noted that S254 is an example of an image obtaining process set forth in the claims.

After execution of S254, the controller 30 instructs the conveying system including the conveying motor 30 to start conveying the printing sheet (5255). Further, the controller 30 causes the image forming device 10 to print an image represented by the image data obtained in S254 on the printing sheet as conveyed (S256). The printing sheet on which the image is printed is discharged on the destination discharge tray. It is noted that S256 is an example of the reprint process set forth in the claims.

After execution of S256, the controller 30 determined, with respect to the destination discharge tray, whether printing of the last page has been completed (S257). When it is determined that printing of the last page has not been completed (S257: NO), the controller 30 returns to S253, increment the page number representing the currently processed page by one, obtain an image of the next page in S254, and print the obtained image. That is, the controller 30 repeats conveyance of the printing sheets to the same discharge tray.

When processing of the last page has been completed (S257: YES), the controller 30 initializes the page number information corresponding to the discharge tray of which the stack full status has been released, and set zero to the page number of the page number information (S271). With these steps, it is regarded that printing related to the discharge tray has been completed.

When the destination discharge tray becomes in the stack full state again (S253: YES), the controller 30 updates the page number contained in the page number information corresponding to the destination discharge tray so as to be the page number currently being processed (S261).

After execution of S261 or S271, the controller instructs the conveying system to stop conveying the printing sheets (S272). After S272, the controller 30 terminates the remainder print process.

After S211 of FIG. 9, the controller 30 releases the storage area storing the image data of the page which becomes unnecessary (S212). That is, as the remainder print process is executed and unprinted pages are printed, it is possible that there exists a page of which multiple copies thereof have been printed. Since it is not necessary to keep storing the image data of such a page, the controller 30 releases the storage area of such image data. For example, in S212, the controller 30 obtains the minimum value other than zero of the page numbers contained in the multiple pieces of page number information corresponding to respective discharge trays, and releases the storage area for the image data corresponding to the pages of which number is less than the minimum value. It is noted that, when all the storage areas allocated for the image data of the print job, the controller 30 sets the image deletion prohibition flag to be "OFF."

After execution of S212, the controller 30 determines whether printing of the designated number of copies of all the pages of the image of the print job has been completed (S213). Determination in S213 is similar to that in S142. When printing of all the number of copies all the pages of the image have not been completed (S213: NO), the controller 30 returns to S203 and repeats to determine whether there exist a discharge tray of which the stack full status has been released and whether the timeout occurs (i.e., the printing sheets fully stacked on the tray have not been removed by the user, and a predetermined period has passed). The above process may be modified such that the controller 30 may return to S202 to reset the timer and then proceed to S203.

When it is determined that the timeout occurs (S204: YES), the controller 30 determines whether it is necessary to execute printing of unprinted pages (S221). Whether the unprinted data is to be printed later or not may be preliminarily stored in the ROM 32 as fixed information, or stored in the NVRAM 34 as user-settable information. Alternatively, whether unprinted data is to be printed is asked to the user every time when decision in S204 is "YES."

When it is determined that printing of the unprinted data is not required (S221: NO), the controller 30 does not print the unprinted data and release all the storage area allocated for the image data of the print job (S222). When printing of the unprinted data is required (S221: YES), the controller 30 determined whether there is an unused tray, which is a discharge tray that is not used in the print job (S231). It is noted that S231 is an example of a tray determination process set forth in the claims. It is noted that a tray in the stack full status is not regarded as the unused tray even though it is not used in the print job. When there is no unused tray (S231: NO), the controller 30 executes the all print process (S232) in which the remaining portion of the print job is printed on the printing sheets, which are discharged on the unused tray.

In the all print process shown in FIG. 11, the controller 30 switches the positions of the flappers so that the printing sheet is conveyed to the unused tray (S281). Then, the controller 30 determines whether printing of the designated number of copies of images of all the pages of the print job has been completed (S282). It is noted that determination in S282 is similar to those in S142 and S213.

When it is determined that printing of all the copies of images for all the pages has not been completed (S282: NO), the controller 30 selects one of the discharge trays corresponding to the page number information storing page numbers other than zero (S290). Then, the controller 30 obtains a page number based on the page number information corresponding to the selected discharge tray (S291). Then, the controller 30 retrieves image data corresponding to the page number (S292). It is noted that S292 is an example of a second image obtaining process set forth in the claims.

After execution of S292, the controller 30 instructs the conveying device including the conveying motor 39 to execute conveyance of the printing sheet (S293). Then, the controller 30 causes the image forming device 10 to print an image represented by the image data retrieved in S292 on the conveyed printing sheet (S294). The printing sheet on which the image is printed is discharged onto the unused tray. It is noted that S294 is an example of a second reprint process set forth in the claims.

After execution of S294, the controller 30 determines whether the destination discharge tray is in the stack full status (S295). When it is determined that the destination discharge tray is not in the stack full status (S295: NO), the controller 30 determines, with respect to the discharge tray selected in S290, whether printing of the last page is completed (S296). When printing of the last page has not completed (S296: NO), the controller 30 increments the page number representing the currently processed page by one, returns to S292 and obtains the image data of the next page, and executes printing of the image of the next page. That is, the process 30 repeats conveyance of the printing sheets with respect to the unused sheet.

When it is determined that printing of the last page has been completed (S296: YES), the controller 30 initializes the page number information corresponding to the discharge tray selected in S290, and stores zero as the page number of the page number information (S297). Thus, printing regarding the discharge tray is regarded to be completed. After execution of S297, the controller 30 returns to S282, and determines whether printing of all the number of copies of the all the pages of the images of the print job has been completed.

When printing of all the copies of all the pages of images of the print job has been completed (S282: YES), or when the destination discharge tray becomes in the stack full status (S295: YES), the controller 30 notifies that printed sheets are conveyed to the unused tray (S283). Since discharging onto the unused tray is not an intention of the user, discharging onto the unused tray is notified so that the user can recognize the same. It is noted that S283 is an example of a notification process set forth in the claims. After execution of S283, the controller 30 terminates the all print process.

In FIG. 9, after execution of S232 (i.e., the all print process), the controller 30 releases all the storage areas allocated for the image data of the print job (S222). According to the all print process in S232, the controller 30 executes printing of the unprinted data and discharge the same on the unused tray before the controller 30 releases the storage area of the image data. Therefore, it is ensured that the user can obtain the output printing sheets without mixing the same with other printing sheets. It is noted that when the timeout has occurred, the user may not remove the printing sheets immediately. If the all print process (i.e., printing of the remaining unprinted pages) is executed, the printing sheets output by the printer 100 may obstruct discharging of the printing sheets according to succeeding print jobs and/or may be taken by another user together with the printing sheets corresponding to another print job by mistake. Therefore, it is optionally preferable that printing of the unprinted pages will not be done (S221: NO) when the timeout has occurred so that the all print process will not be executed.

When printing of all the copies of all the pages of the images has been completed (S213: YES), or S222 is executed, the controller 30 terminates the print restart process. Thereafter, the controller 30 returns to FIG. 7 and terminates the sort printing process.

For example, when the printer 100 executes the sort printing process to print two copies of a document of N pages, using a first tray (e.g., the upper tray 23) and a second tray (e.g., the lower tray 21), the following processes may be executed.

Initially, a first sort printing process is executed. When a signal output by a first sensor (e.g., an upper stack sensor 29) is switched, during execution of the first sort printing process, from a non-full status signal, which represents the height of the stack of the printing sheets does not exceed the particular height, to a full status signal, which represents the height of the stack of the printing sheets exceeds the particular height, the controller executes, the page number "m" of the page which is supposed to be output to the first tray in association with the first tray is stored, and a second sort printing process to print an image of a page associated with the print job on a sheet and discharge the printed sheet on the second tray, repeatedly, from the m-th page to N-th page. Thereafter, when a signal output by the first sensor is switched, during execution of the second sort printing process, from the full status signal to the non-full status signal, the stored page number "m" is retrieved and printing images of the m-th page to N-th page is executed and the printed sheets are discharged onto the first tray.

As described in detail above, according to the printer 100, when it is detected that the stack full status occurs in one of the discharge tray during execution of the sort printing process, discharging the printing sheets to the stack-full discharge tray is stopped, the number of copies is reduced so that the printing on the printing sheet to be discharged to the slack-full discharge tray is skipped, thereby bad effect in sorting on the other discharge tray can be avoided.

Further, the printer 100 is configured to store the page number in association with the stack-full discharge tray when the discharge to the stack-full discharge tray is stopped. When the stack full status is resolved (e.g., when the user remove the printing sheets of the stack-full discharge tray), the printer 100 retrieves the image data corresponding to the stored page number and subsequent pages, print the images of the retrieved image data, and discharge the pages on the discharge tray which was in the stack full status, thereby the skipped printing operation being executed. With the above process, the user can obtain all the intended printing sheets.

According to the printer 100, when the destination discharge tray is in the stack full status, printing images on the printing sheets which are to be discharged to the stuck-full discharge tray and thus discharging the same are skipped, while keep continuing printing images on the printing sheets to be discharged on the other discharge trays. When the stack-full status of the stack-full discharge tray is released, the skipped printing and discharging operations are executed, thereby the print job being completed. Accordingly, in comparison with a configuration where execution of entire print job is interrupted when the stack full status occurs and the print job is restored after the stack full status is released, the entire print job can be completed earlier according to the above-described configuration.

It is noted that the above-described embodiment is only an illustrative embodiment and is not intended to restrict scope of the disclosures. Thus, according to aspects of the disclosures, the above-described illustrative embodiment could be modified in various ways without departing the scope of the disclosures. For example, the configuration described above may be applied not only to the printer but can be applied to any other apparatus having a printing function (e.g., an MFP (multi-function peripheral), a copying apparatus, a facsimile apparatus and the like). Further, the image forming device 10 need not be limited to one according to the electrophotographic image forming method, but can be of an inkjet method. Furthermore, the image forming device 10 need not be limited to one forming only monochromatic images but can be one configured to form color image also.

The printer 100 according to the illustrative embodiment has four discharge trays including the main body discharge tray. It is noted that the number of the discharge trays need not be Limited to four, but can be less than or more than four. Further, although the order of destination discharge trays is preliminarily defined in the illustrative embodiment (i.e., in the order of lower stage tray 21, the middle stage tray 22, the upper stage tray 23 and the main body tray 121), the order need not be limited to this order. For example, the order may be determined from a lower one to an upper one (e.g., in the order of the main body tray 121, the lower stage tray 21, the middle stage tray 22 and the upper stage tray 23).

According to the above-described illustrative embodiment, when the destination discharge tray is in the stack full status, release of the storage area storing the image data is prohibited, and the image data is kept stored in the RAM 33. Then, after release of the stack full status, printing is restarted with use of the image data held in the RAM 33. This configuration may be modified such that the storage area of the image data may be released when the stack full status occurs. In such a case, after the stack full status is released, the controller 30 may allocate the storage area for the image data again, request the sender of the print job to resend the image data corresponding to the page stored in S121 and subsequent pages, and may execute printing based on the received image data. According to such a configuration, by once releasing the storage area for unprinted image data when the stack full status occurs, and allocating the storage area for the unprinted image data again and receive the same from the sender after the stack full status is released, load to the RAM 33 can be reduced. In contrast, according to the configuration of the illustrative embodiment, since the storage area for the unprinted image data is not released, printing can be restarted quickly after the stack full status is released.

According to the illustrative embodiment, when printing of all the copies of a certain page is completed, the storage area storing the image corresponding to the certain page is released immediately in S132 or S212. It is noted that a timing when the storage area is released need not be limited to such a timing. For example, the storage area of all the image data may be released when printing of the images of all the pages has been completed.

Further, according to the printer 100, when the destination discharge tray becomes in the stack full status during the sort printing, discharging of the sheet to the stack-full discharge tray and printing on the sheet to be discharged to the stack-full discharge tray is skipped. It is noted that discharging and printing may also be skipped when discharging of the printing sheet to a destination discharge tray cannot be done due to a reason other than the stack-full status. An example of a case where such a control is applicable is a case where the printing sheet is jammed after a trailing end of the sheet passed the flapper immediately before the discharge opening.

What is claimed is:

1. A printing apparatus, comprising:

a printing device configured to print an image on a printing sheet;

a plurality of trays configured to receive the printing sheet on which image are formed by the printing device;

a plurality of sensors respectively provided to the plurality of trays, each of the plurality of sensors outputting signals which are different depending on whether a height of a stack of the printing sheets received by the corresponding tray exceeds a particular height;

a conveying device configured to convey the printing sheet inside the printing apparatus;

a storage device; and a controller, wherein the controller is configured to execute:

a receiving process in which the controller receives a print job associated with a printing operation from an external apparatus;

a number of copies obtaining process in which the controller obtains a number of copies of a document to be made for the print job, the document having a plurality of pages, the number of copies of the document to be printed being a first number;

a sort printing process of repeatedly causing, for a first page through a last page of the document:

the printing device to print the first number of copies of a page of the document; and the conveying device to discharge the first number of copies of the printed page to the first number of destination trays, respectively, among the plurality of trays;

a full status determination process in which the controller determines whether a signal output by at least one of the sensors respectively provided to the destination trays is switched, during execution of the sort printing process, from a non-full status signal, which represents the height of the stack of the printing sheets does not exceed the particular height, to a full status signal, which represents the height of the stack of the printing sheets exceeds the particular height, wherein, when the controller determines that a signal output by at least one of the sensors is switched from the non-full status signal to the full status signal, the controller is further configured to execute:

a storing process in which the controller causes the storage device to store the page number of the page currently printed in association with a stack-full tray which is a tray corresponding to the sensor determined in the full status determination process that the output signal is changed from the non-full status signal to the full status signal;

a modifying process in which the controller stops discharging the printing sheets to the stack-full tray and reduces the first number of copies of the document made in the sort printing process from the first number obtained in the number of copies obtaining process to a second number, which is obtained by subtracting the number of full-status trays from the first number;

a continuous printing process in which the controller continues to execute the sort printing process such that the controller prints the second number of copies of the document and discharge the second number of copies of the document to the second number of destination trays, respectively, the second number of destination trays being other than the stack-full tray;

a release determination process in which the controller determines whether the signal output by the sensor corresponding to at least one of the stack-full trays is changed from the full status signal to the non-full status signal;

an image obtaining process in which the controller obtains image data corresponding to the page associated with the stack-full tray and stored in the storage device in the storing process and the subsequent pages from the external apparatus from which the print job is received when it is determined in the release determination process that the signal output by the sensor corresponding to at least one of the stack-full trays is changed from the full status signal to the non-full status signal; and a reprinting process in which the controller causes the printing device to print images obtained in the image obtaining process with making the tray of which sensor is determined to change the output signal from the full status signal to the non-full status signal the destination tray.

2. The printing apparatus according to claim 1, wherein the controller is configured to store the image data corresponding to the page currently printing and subsequent pages in a storage area allocated in the storage device when it is determined in the full status determination process that the output signal of the sensor is changed during execution of the sort printing process, and wherein the controller is configured to retrieve the image data from the storage device in the image obtaining process.

3. The printing apparatus according to claim 2, wherein the controller is configured to release the storage area of the storage device storing image data of respective pages in response to completion of printing of the number of copies obtained in the number of copies obtaining process.

4. The printing apparatus according to claim 2, wherein the controller is configured to release the storage area of the storage device storing image data when a waiting time period in which the signal output by the sensor corresponding to the stack-full tray is changed from the full status signal to the non-full status signal exceeds a particular time period.

5. The printing apparatus according to claim 1, wherein the controller is further configured to execute:

a tray determining process in which the controller determines whether there exists an unused tray which is a tray other than the trays determined to be the destination trays in the sort printing process and the corresponding sensor is outputting the non-full status signal when a waiting time period in which the signal output by the sensor corresponding to the stack-full tray is changed from the full status signal to the non-full status signal exceeds a particular time period;

a second image obtaining process in which the controller obtains image data corresponding to the page associated with the stack-full tray and the subsequent pages when it is determined in the tray determining process that there exists the unused tray; and a second reprinting process in which the controller causes the printing device to print the images represented by the image data obtained in the second image obtaining process with making the unused tray as the destination tray after execution of the sort printing process.

6. The printing apparatus according to claim 5, wherein the controller is configured to notify that the printing sheets are discharged onto the unused tray when the image data is printed according to the second reprinting process.

7. A sheet discharge method for a printing apparatus, comprising:

a receiving step of receiving a print job associated with a printing operation from an external apparatus;

a number of copies obtaining step of obtaining a number of copies of a document to be made for the print job, the document having a plurality of pages, the number of copies of the document to be printed being a first number;

a sort printing step of repeatedly causing, for a first page through a last page of the document:

a printing device of the printing apparatus to print the first number of copies of a page of the document and a conveying device of the printing apparatus to discharge the first number of copies of the printed page to the first number of destination trays, respectively, among the plurality of trays;

a full status determination step of determining whether a signal output by at least one of sensors respectively provided to the destination trays is switched, during execution of the sort printing process, from a non-full status signal, which represents the height of the stack of the printing sheets does not exceed the particular height, to a full status signal, which represents the height of the stack of the printing sheets exceeds the particular height, wherein, when the controller determines that a signal output by at least one of the sensors is switched from the non-full status signal to the full status signal, the controller is further configured to execute:

a storing step, when a signal output by at least one of the sensors is switched from the non-full status signal to the full status signal, of causing a storage device of the printing apparatus to store the page number of the page currently printed in association with a stack-full tray which is a tray corresponding to the sensor determined in the full status determination step that the output signal is changed from the non-full status signal to the full status signal;

a modifying step in which the controller stops discharging of the printing sheets to the stack-full tray and reduces the first number of copies of the document made in the sort printing step from the first number obtained in the number of copies obtaining step to a second number, which is obtained by subtracting the number of full-status trays from the first number;

a continuous printing step of continuing the sort printing step of printing the second number of copies of the document and discharging the second number of copies of the document to the second number of destination trays, respectively, the second number of destination trays being other than the stack-full tray;

a release determination step of determining whether the signal output by the sensor corresponding to at least one of the stack-full trays is changed from the full status signal to the non-full status signal;

an image obtaining step of obtaining image data corresponding to the page associated with the stack-full tray and stored in the storage device in the storing process and the subsequent pages from the external apparatus from which the print job is received when it is determined in the release determination step that the signal output by the sensor corresponding to at least one of the stack-full trays is changed from the full status signal to the non-full status signal; and a reprinting step causing the printing device to print images obtained in the image obtaining step with making the tray of which sensor is determined to change the output signal from the full status signal to the non-full status signal the destination tray.

8. A printing apparatus, comprising:

a printing device configured to print an image on a printing sheet;

a first tray configured to receive the printing sheet on which image is formed by the printing device;

a second tray configured to receive the printing sheet on which image is formed by the printing device;

a first sensor provided to the first tray and outputs signals which are different depending on whether a height of a stack of the printing sheets accommodated in the first tray exceeds a particular height;

a storage device; and a controller, wherein the controller is configured to execute:

a first sort printing process in response to receipt of a sort print job to generate two copies of N pages of printed sheets, the first sort printing process being a process to print an image of each of first page to N-th page of the print job associated with the sort print job on two sheets and discharge the two sheets onto the first tray and the second tray, respectively:

when a signal output by the first sensor is switched, during execution of the first sort printing process, from a non-full status signal, which represents the height of the stack of the printing sheets does not exceed the particular height, to a full status signal, which represents the height of the stack of the printing sheets exceeds the particular height, the controller executes:

a storing process in which the controller causes the storage device to store the page number m of the page which is supposed to be output to the first tray in association with the first tray, the m-th page being the page not outputted to the first tray in response to the full status signal;

a second sort printing process to print an image of a page associated with the print job on a sheet and discharge the printed sheet on the second tray, repeatedly, from the m-th page to N-th page; and when a signal output by the first sensor is switched, during execution of the second sort printing process, from the full status signal to the non-full status signal, the controller executes reprinting process in which the controller:

retrieves the page number m stored in the storing process from the storage device; and prints images of the m-th page to N-th page of the sort print job onto respective sheets which are discharged onto the first tray.

* * * * *